United States Patent [19]

Colleran et al.

[11] Patent Number: 4,693,532

[45] Date of Patent: Sep. 15, 1987

[54] MODULAR STAGGERED MULTI-ROW ELECTRICAL CONNECTOR

[75] Inventors: Stephen A. Colleran, Plainfield; William R. Lenz, Crestwood, both of Ill.

[73] Assignee: Molex Incorporated, Lisle, Ill.

[21] Appl. No.: 887,968

[22] Filed: Jul. 21, 1986

Related U.S. Application Data

[63] Continuation of Ser. No. 698,504, Feb. 4, 1985, abandoned.

[51] Int. Cl.[4] ..... H01R 11/22

[52] U.S. Cl. ..... 439/594; 439/405; 439/677; 439/717; 439/629

[58] Field of Search ..... 339/97 R, 97 P, 98, 339/99 R, 210 R, 210 M, 17 R, 17 C, 217 S, 59 M, 59 R, 60 R, 60 M, 176 M, 184 M, 176 MP

[56] References Cited

U.S. PATENT DOCUMENTS

| | | | |
|---|---|---|---|
| 3,500,288 | 5/1968 | Startin | 339/17 C |
| 3,517,803 | 6/1970 | Frompovicz | 339/59 M |
| 4,035,050 | 7/1977 | Volinskie | 339/99 R |
| 4,091,531 | 5/1978 | Grubb et al. | 29/749 |
| 4,230,387 | 10/1980 | Zahn | 339/59 M |

*Primary Examiner*—Gil Weidenfeld
*Assistant Examiner*—Thomas M. Kline
*Attorney, Agent, or Firm*—John W. Cornell; Louis A. Hecht

[57] ABSTRACT

A modular, multi-row, mass terminated electrical connector which mates with an array of pins. The connector includes a housing having top and bottom rows of elongated terminal receiving cavities each with a forward pin receiving opening. A plurality of terminals are mounted in the cavities with each terminal having a forward pin engaging portion and a rear insulation displacement portion. The cavities of the top rows are staggered with respect to the cavities of the bottom row and the adjacent top row cavities are spaced apart from one another. An access slot is formed in the top of each cavity to expose the insulation displacement portion of the terminals. The insulation displacement portion of the terminals received in the bottom row cavities are accessible between adjacent top row cavities so that all of the terminals of both rows can be mass terminated from the top of the connector. The housing is made up of a plurality of modules connected together by means of selectively removable connecting members. A desired number of modules may be removed to have a connector that will mate with a desired pin array.

5 Claims, 9 Drawing Figures

FIG. 6
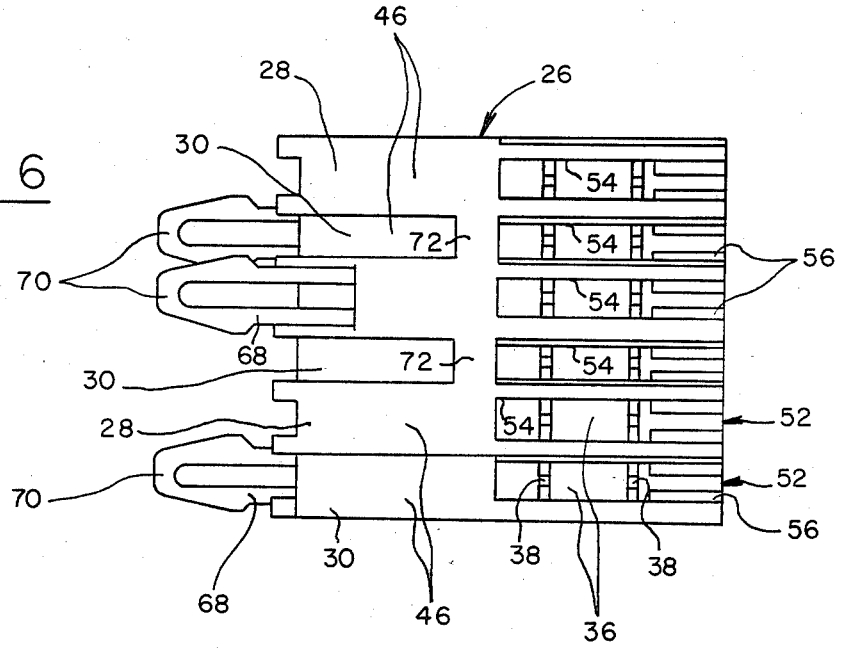
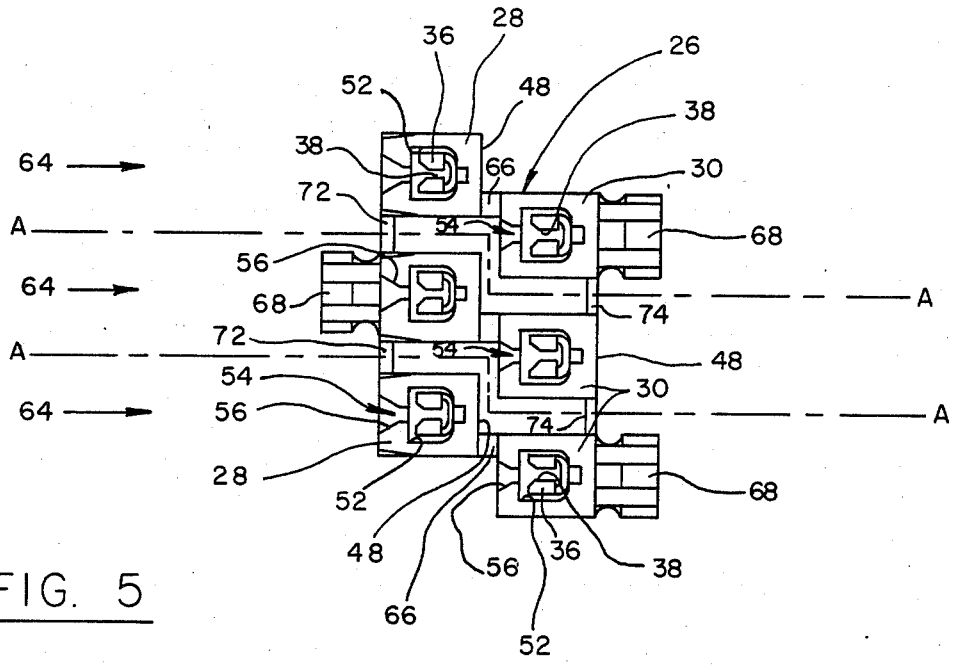
FIG. 5

MODULAR STAGGERED MULTI-ROW ELECTRICAL CONNECTOR

This application is a continuation, of application Ser. No. 698,504 filed Feb. 4, 1985, now abandoned.

BACKGROUND OF THE INVENTION

1. Field of the Invention

The present invention generally relates to a modular multi-row electrical connector which mates with an array of pins.

2. Brief Description of the Prior Art

More electronic devices are being designed with an increased number of components which are adapted to be mounted on a printed circuit board. As a result, space on a printed circuit board is one of the prime design considerations when attempting to lay out the locations of various components thereon.

One type of component frequently found on printed circuit boards are square wire pins. Some pins have a nominal dimension of 0.045 inch and are adapted to be force fit through punched holes in the printed circuit board. After the pins are inserted into the printed circuit board, they are wave soldered to provide an electrical connection between the pins and the circuitry formed on the board.

Along with miniaturization, came the advent of 0.025 inch square wire pins. The advantage of the smaller pin is that a smaller mating female connector could be used. Thus, less printed circuit board area would be used. To illustrate this point, normally a 0.045 inch square wire pin array is used to mate with a 0.156 inch center spaced female connector. On the other hand, a 0.025 inch square wire pin can mate with a 0.100 inch center spaced female connector which takes up less space that a 0.156 connector for the same number of circuits or pins. A disadvantage of using 0.025 inch square wire pins is that the preformed holes must be drilled because of the smaller cross section rather than punched as with the 0.045 inch square wire pins. It is more expensive to drill than to punch holes in a printed circuit board. Also, a 0.025 inch square wire pin cannot carry as much current as a 0.045 inch square wire pin.

One reason why 0.045 inch square wire pins were not used in conjunction with 0.100 inch spaced connectors is that if parallel rows of 0.045 inch square wire pins were mounted on a printed circuit board, there would be insufficient material between the rows of pins to maintain both the electrical and mechanical integrity of the board. There is usually a trade-off between efficient use of printed circuit board area vs. manufacturing efficiency.

With respect to the female or pin receiving connector that mates with the array of two rows of pins mounted in a printed circuit board, it is been advantageous to mass terminate the wires to the connectors. Generally speaking, female connectors of this type include a housing made of insulation material having parallel top and bottom rows of elongated terminal receiving cavities, each cavity having a pin receiving opening in a forward end and a wire receiving opening at the rearward end. The pin receiving openings are in the same configuration as the multi-row pin array. A plurality of terminals are provided to be mounted in the cavities. Each terminal has a pin engaging portion at the forward end and a wire engaging portion at the rearward end.

An example of a female connector of this type is disclosed in U.S. Pat. No. 4,243,288. The terminals of each row are mass terminated to insulated wire conductors by conventional insulation displacement means. However, because the wire engaging portions of the terminals of the two rows are oppositely facing, it is impossible to simultaneously terminate both rows of terminals from the same direction. Thus, the application tool must have two wire stuffing members in order to achieve simultaneous mass termination of both rows of each row must be terminated separately with the same wire stuffing member.

One means of producing mass termination of a dual row connector of the type described is disclosed in U.S. Pat. No. 4,486,950. In this patent, two end-to-end rows of terminal receiving cavities (and the wire engaging portion received therein) are all facing in the same direction and are linearly connected together by a living hinge. After mass termination one row is bent back against the other row and latched together. This kind of housing is expensive to manufacture and to assemble.

In addition, if a particular printed circuit board has more than one multi-row array of pins, with each array having a different number of pins, two different female connectors would have to be manufactured. Each connector would have a housing with a different number of circuits.

A modular connector housing is disclosed in U.S. Pat. No. 4,492,023 which relates to a method and apparatus for fabricating an electrical harness. The type of connector illustrated therein is a plurality of single row connectors which have an integrally formed housing structure. The housings are connected together by means of a selectively removable web or connecting member.

SUMMARY OF THE INVENTION

It is, therefore, a principal object of the present invention to provide a multi-row electrical connector for connecting an array of pins to insulated wire conductors which can be mass terminated from the same side of the connector. The connector for performing this object includes a housing made of insulation material having parallel top and bottom rows of elongated terminal receiving cavities, each cavity generally defined between two-spaced apart side walls, a top wall and a bottom wall, each cavity having a pin receiving opening in a forward end and a wire receiving opening at the rearward end, said pin receiving openings being in the same configuration as said pin array, a plurality of terminals, each mounted in a cavity, and each having a pin engaging portion at the forward end and a wire engaging portion at the rearward end, the improvement comprising:

the wire engaging portion of each terminal includes an insulation displacement slot for receiving an insulated conductor therein, displacing the insulation and electrically contacting the conductors;

the cavities of the top row being staggered with respect to the cavities of the bottom row;

the side walls of adjacent top row cavities being spaced apart; and a slot formed in the top wall of each cavity extending from the wire receiving opening towards the forward end to expose the wire engaging portion of the terminals;

whereby the wire engaging portions of the terminals received in the bottom row cavities are accessible between the side walls of adjacent top row cavities so that all the terminals of both rows can be mass terminated from the top of the connector.

It is another object of the present invention to provide a modular connector housing structure to form an electrical connector for connecting any given one of different multi-row arrays of pins to insulated wire conductors so that the same product can be adapted for mating with different arrays of pins. The connector includes a plurality of terminals each having a pin engaging portion at the forward end and a wire engaging portion at the rearward end and an integrally formed housing structure made of insulative material having a plurality of rows of elongated terminal receiving cavities including a top row and a bottom row, each cavity generally defined between two spaced-apart side walls, a top wall and a bottom wall, each cavity having a pin receiving opening in the forward end and a wire receiving opening in the rearward end, said housing structure comprising:

a plurality of modules, each module including at least one top row cavity and at least one bottom row cavity, said pin receiving opening of said module being in the same configuration of a part of the given in array; and selectively removable module connecting members for connecting a plurality of modules to each other;

whereby a desired number of modules may be removed from the housing structure leaving a plurality of modules comprising a connector housing having pin openings of the same configuration as the given pin array.

BRIEF DESCRIPTION OF THE DRAWINGS

FIG. 5 is an end view of the connector of the present invention looking at the rearward end;

FIG. 6 is a top plan view of the connector of the present invention;

DESCRIPTION OF THE PREFERRED EMBODIMENT

Figure 1:
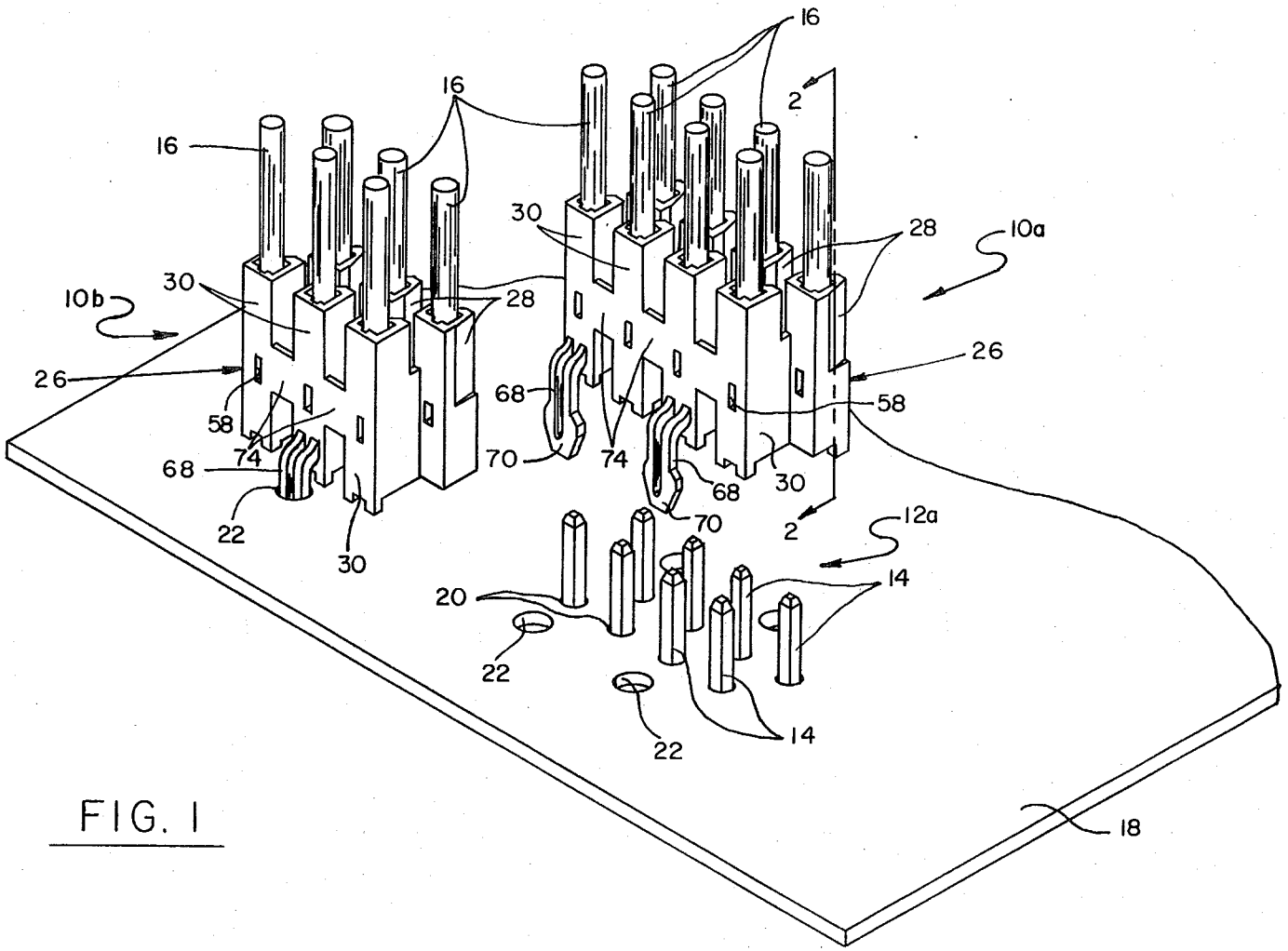
FIG. 1 is a perspective view of two different wire terminated connectors made according to the present invention, one of which is mounted on a printed circuit board.

Turning now to FIG. 1, two different dual row electrical female connectors, generally designated 10*a* and 10*b*, are shown. Each connector 10*a* and 10*b* is used for connecting a dual row array, generally designated 12*a* (the pin array mating with connector 10*b* cannot be seen) of pins 14 to insulated wire conductors 16.

The pins 14 are mounted on a printed circuit board 18 through pin holes 20 prepunched therein. A plurality of polarizing holes 22 are also formed in the board for purposes which will be described in greater detail hereinafter.

Each connector 10*a* or 10*b* (also, generally referred to as 10) includes a housing generally designated 26, integrally molded from insulative dielectric material such as plastic material. The housing 26 has parallel top and bottom rows of elongated terminal receiving cavities 28 and 30, respectively. Each cavity 28 and 30 is adapted to receive a metal terminal generally designated 32, therein.

Figure 3:
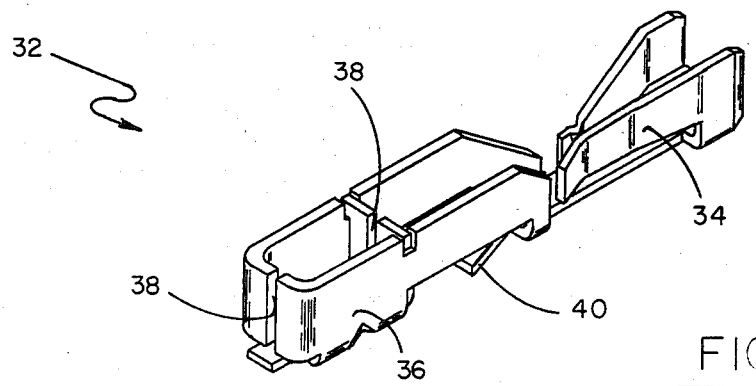
FIG. 3 is a perspective view of a terminal which is mounted in a connector of the present invention.
Figure 4:
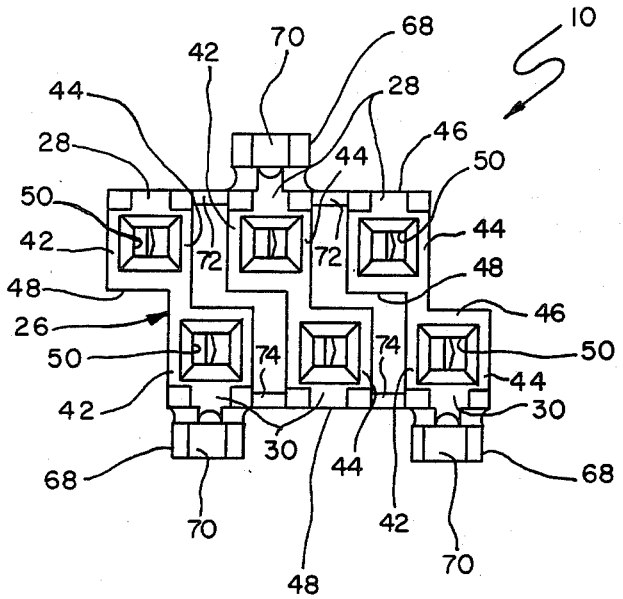
FIG. 4 is an end view of the connector of the present invention looking at the forward end.
Figure 2:
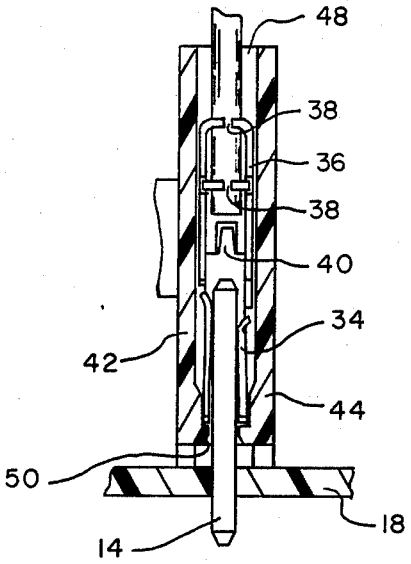
FIG. 2 is a sectional view taken generally along the line 2—2 of FIG. 1.
Figure 7:
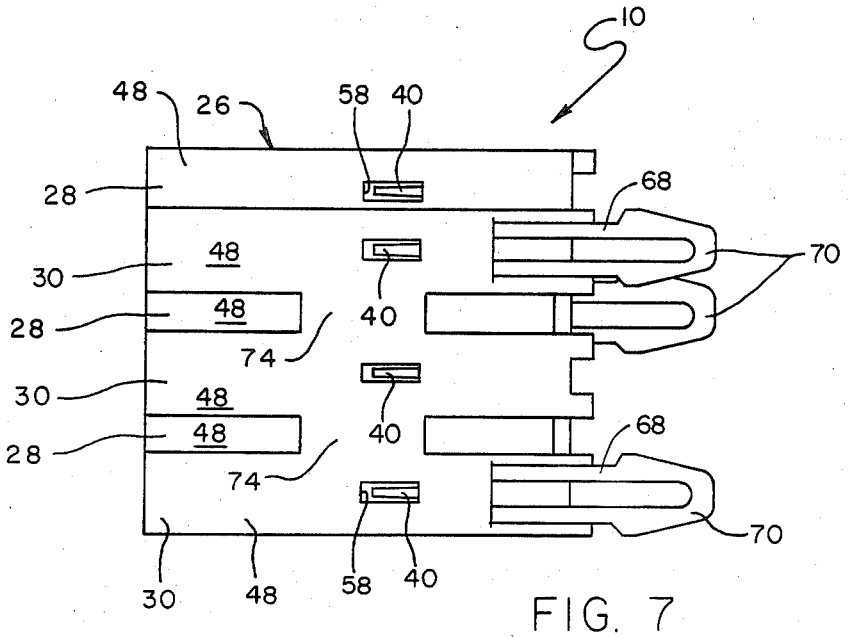
FIG. 7 is a bottom plan view of the connector of the present invention.
Figure 8:
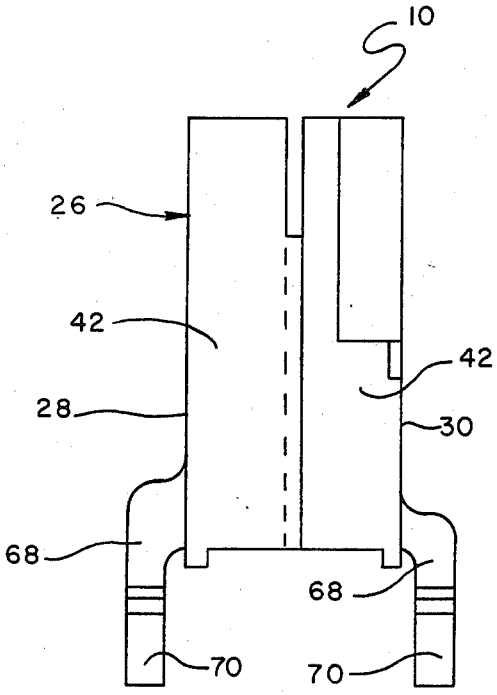
FIG. 8 is a side view of the connector of the present invention.

Looking at FIG. 3, the terminal 32 is seen to generally include a pin engaging portion 34 of conventional design which is adapted to receive one of the pins 14. At the opposite end of terminal 32 is a wire engaging portion 36 which has a conventional insulation displacement type slot 38 formed therein. When the insulated wire conductor 16 is moved laterally into the slot 38, the insulation is displaced and the wire engaging portion 36 of the terminal 32 electrically contacts the metal conductor.

The terminal 32 also includes a locking lance 40 struck out from the bottom thereof. The locking lance 40 engages a portion of respective cavity 28 or 30.

Each terminal receiving cavity, 28 and 30, is defined between two spaced apart side walls 42 and 44, a top wall 46 and bottom wall 48. Each cavity, 28 and 30, further has a pin receiving opening 50 in the forward end and a wire receiving opeing 52 in the rearward end. The pin receiving openings 50 are in the same configuration as the mating pin array, 12*a* or 12*b*.

The top wall 46 of each cavity 28 or 30 has a slot 54 formed therein extending from the wire receiving opening 52 toward the forward end. A lead in portion 56 is formed depending from the slot 54. The slot 54 and lead in portion 56 are used to allow a wire conductor 16 to be guided into a cavity 28 and 30 for electrical connection to the wire engaging portion 36 of terminal 32.

A locking window 58 is formed in the bottom wall 48 of each cavity 28 and 30. The window 58 cooperates with the terminal locking lance 40 for the purpose of maintaining terminal within its respective cavity.

As can be seen, the top row of cavities 28 are staggered with respect to the bottom row of cavities 30. The arrays 12*a* and 12*b* allow for the use of 0.045 inch square wire pins with closer spacing between the respective rows thereof by staggering one row of pins with respect to the other row. As shown in FIG. 1, the staggered pin receiving openings 50 conform with the corresponding array 12*a* and 12*b*.

It is significant that the side walls 42 and 44 of adjacent cavities 28 and 30 are spaced apart and do not form a common wall as in most prior art connectors. The space or area between the side walls 42 and 44 of adjacent cavities 28 of the top row allow for the accessibilty of the wire engaging portions 36 of the terminals 32 mounted in the bottom row cavities 30 so that they are exposed to the top of the connector 10 through slot 56. Because of this structure, the wire engaging portions 36 of all of the terminals face upwardly. Therefore, all of the wires 12 can be terminated simultaneously from the same side of the connector 10.

Turning again to FIG. 1, the same manufactured part is used to result in both connectors 10*a* and 10*b*. This is accomplished by integrally molding a plurality of modules, generally designated 64 and defined between lines A—A of FIG. 5, connected to one another to form the connector of the present invention.

Each module 64 has one top row cavity 28 and one bottom row cavity 30 connected together by means of a web 66. Web 66 is an extension of side wall 44 of the top row cavity and side wall 42 of the bottom row cavity 30.

Each module 64 has a peg 68 extending beyond the forward end of the housing 26. Every other module 64 has the peg 68 extending from the top row cavity 28 while the adjacent modules have their pegs extending from the bottom row cavity 30.

Pegs 68 are adapted to be received in printed circuit board holes 22 and serve two purposes. The first purpose is to polarize the connector 10 so that the right connector 10*a* and 10*b* is mated with the correct pin array 12*a* and 12*b*, respectively. The second purpose is to lock or hold the connector 10 onto the printed circuit board 18. To this end, a flexible bubble portion 70 is formed on the end of each peg 68 to engage the bottom surface of the printed circuit board 18 when the peg 68 is inserted through hole 22.

Adjacent modules 64 are integrally connected to one another by means of selectively removable module connecting members 72 and 74 connecting the top row cavities 28 and bottom row cavities 30, respectively. Alternatively, adjacent modules 64 can be connected to one another by either or connecting members 72 or 74. Connecting members 72 and 74 can be removed by suitable means in order to detach one or more modules 64 from the structure to form a housing 26 of a desired configuration.

In addition, peg 68 is selectively removable. If peg 68 is not required, it, too, can be removed by suitable means.

By using the housing structure disclosed herein, the efficiencies of manufacturing one product are achieved. Further efficiencies can be enjoyed by virtue of the ability to mass terminate a multi-row connector from the same side.

Figure 9:
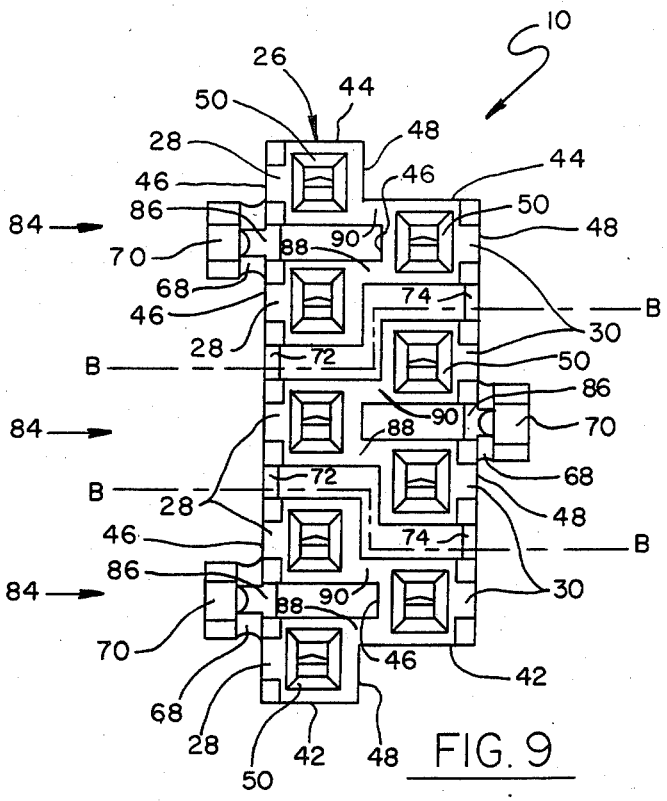
FIG. 9 is an enlarged end view of the two modules comprising a different housing structure made according to the present invention.

Although FIGS. 1 and 4–8 show a module 64 containing two cavities 28 and 30, it is to be understood that practically any sized module containing at least one top row cavity 28 and one bottom row cavity 30 can be designed. For example, FIG. 9 shows modules 84 defined between lines B—B of FIG. 9 each comprising three cavities.

Each module 84 has two cavities 28 or 30 of one row connected to one cavity of the other row 28 or 30. The modules 84 are arranged in an alternating flip-flop fashion so that a module 84 comprising one top row cavity 28 and two adjacent bottom row cavities 30 is adjacent to a module 84 which comprises two top row cavities and one bottom row cavity 30.

The cavities 28 and 30 of each module 84 are connected to one another by means of three webs 86, 88 and 90. Web 86 connects the two adjacent cavities in the same row between their respective side walls 42 and 44 near the forward end thereof. In a module 84 where the two adjacent cavities 38 are on the top row, web 86 is an extension of the top walls 46 thereof. Where the module 84 comprises two adjacent cavities in the bottom row 30, web 86 is an extension of the bottom walls 48 thereof.

Webs 88 and 90 connect the one cavity of one row with the two adjacent cavities of the other row. In the case where the module 84 comprises the single cavity in the top row, webs 88 and 90 extend downwardly as extensions of side walls 42 and 44 to connect with side walls 44 and 42 of different adjacent bottom row cavities 30. If the module 84 has a single cavity on the bottom row, then webs 88 and 90 extend upwardly as extensions of side walls 42 and 44 to connect with side walls 44 and 42 of different adjacent top row cavities 28.

The peg 68 extends beyond the forward end of the housing 26 from webs 86. Thus, there is one peg 68 for each module 84. The pegs 68 are adapted to be received in holes 22 formed in the printed circuit board 18 in the manner discussed above.

Adjacent modules 84 are integrally connected to one another by means of the top row and bottom row selectively removeable module connecting members 72 and 74, respectively. Connecting members 72 and 74 are similar to webs 86 except they do not have the peg 68 formed thereon. The connecting members 72 and 74 may be removed to form the desired connector 10 as described above.

We claim:

1. A dual row, modular, mass terminatable electrical connector for connecting a dual row array of pins to insulated wire conductors, said connector including a housing made of insulative material having parallel top and bottom rows of elongated terminal receiving cavities, each cavity generally defined between two spaced-apart sidewalls, a top wall and a bottom wall, each cavity having a forward pin receiving opening and a rear wire receiving opening, and a plurality of identical terminals, one mounted with the same orientation in each cavity, and each terminal having a forward pin engaging portion and a rear insulation displacement slot for receiving an insulated conductor therein, displacing the insulation and electrically contacting the conductor, the improvement comprising:

the cavities of the top row being staggered with respect to the cavities of the bottom row;

the sidewalls of adjacent cavities of the top and bottom rows being spaced-apart;

a slot formed in each of the top walls of the cavities of the top and bottom rows, each slot extending from the wire receiving opening toward the forward end to expose the insulation displacement slot, whereby the insulation displacement slots of the terminals received in the bottom row cavities are accessible between the sidewalls of adjacent top row cavities so that all of the terminals of both rows can be mass terminated from one direction; and said housing having a plurality of modules, each module including at least one top row cavity and at least one bottom row cavity and selectively removable module connecting members joining predetermined adjacent cavity sidewalls for connecting a plurality of modules together, whereby a desired number of modules may be removed from the housing leaving a connector having the same number of pin receiving opeings as there are pins in a given pin array.

2. The connector of claim 1 wherein said module connecting members are formed between every two adjacent top row cavities of adjacent modules and every two adjacent bottom row cavities of adjacent modules.

3. The structure of claim 1 including selectively removeable polarizing means extending from each module beyond the forward end thereof for cooperation with a pin mounting surface.

4. The connector of claim 2 wherein each module comprises three cavities including one top row cavity and two adjacent bottom row cavities or one bottom row cavity and two adjacent top row cavities.

5. The connector of claim 2 wherein each module includes a web joining said top row cavity and said bottom row cavity of the same module.

* * * * *